US006333730B1

(12) United States Patent
Lee

(10) Patent No.: US 6,333,730 B1
(45) **Date of Patent: *Dec. 25, 2001**

(54) SOURCE DRIVER OF LIQUID CRYSTAL DISPLAY AND METHOD FOR DRIVING THE SAME

(75) Inventor: Seung-Jong Lee, Kyungki-do (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/023,713

(22) Filed: Feb. 13, 1998

(30) Foreign Application Priority Data

Mar. 5, 1997 (KR) ..... 97-7285

(51) Int. Cl.[7] ..... G09G 3/36
(52) U.S. Cl. ..... 345/100; 345/98
(58) Field of Search ..... 345/100, 98, 99, 345/213, 507, 132, 88, 204, 197; 348/511

(56) References Cited

U.S. PATENT DOCUMENTS

| | | | | |
|---|---|---|---|---|
| 4,500,908 | | 2/1985 | Mandeberg . | |
| 4,642,628 | | 2/1987 | Murata | 345/88 |
| 5,192,945 | * | 3/1993 | Kusada | 345/88 |
| 5,406,304 | | 4/1995 | Shirayama | 345/98 |
| 5,414,443 | * | 5/1995 | Kanatani et al. | 345/95 |
| 5,574,475 | | 11/1996 | Callahan, Jr. et al. . | |
| 5,751,261 | * | 5/1998 | Zavracky et al. | 345/55 |
| 5,754,156 | * | 5/1998 | Erhart et al. | 345/98 |
| 5,929,832 | * | 7/1999 | Furukawa et al. | 345/98 |
| 5,963,183 | * | 10/1999 | Takahashi | 345/3 |
| 5,973,660 | * | 10/1999 | Hashimoto | 345/98 |
| 5,990,858 | * | 11/1999 | Ozolins | 345/99 |

FOREIGN PATENT DOCUMENTS

| | | |
|---|---|---|
| 19716095 | 4/1996 | (DE) . |
| 0391655 | 4/1990 | (EP) . |
| 0 368 572 A2 | 5/1990 | (EP) . |
| 0 391 655 A2 | 10/1990 | (EP) . |
| 0 546 780 A1 | 6/1993 | (EP) . |
| 0 574 142 A1 | 12/1993 | (EP) . |

OTHER PUBLICATIONS

Kato, F. et al. "An 8.bit Digital Data Driver for CoPoR TFT–LCDs" SID Digest, vol. XXVII pp. 247–250, May 1996.*

* cited by examiner

*Primary Examiner*—Richard Hjerpe
*Assistant Examiner*—Frances Nguyen
(74) *Attorney, Agent, or Firm*—Finnegan, Henderson, Farabow, Garrett, & Dunner, L.L.P.

(57) ABSTRACT

A source driver of a liquid crystal display (LCD) having a multi-scan function and a method for driving the same are disclosed, the source drive of an LCD includes a shift register for shifting and outputting a carry input/output (I/O) signal, a latch section including first, second, and third latches for sequentially storing R, G, and B external image signal data, holding the stored data, and outputting stored image signal data synchronously with the carry I/O signal. Further, a digital/analog (D/A) converter for converts the image data output by the latch section into an analog image signal based on external POL signal, a data output part for outputs the analog image signal, and a controlling section controls operation of the three latches so as not to operate data input and data output in the same latch.

19 Claims, 9 Drawing Sheets

SOURCE DRIVER OF LIQUID CRYSTAL DISPLAY AND METHOD FOR DRIVING THE SAME

BACKGROUND OF THE INVENTION

1. Field of the Invention

The present invention relates to a thin film transistor liquid crystal device (TFT-LCD) and, more particularly, to a source driver of a liquid crystal display (LCD) having a multi-scan function and a method for driving the same.

2. Discussion of the Related Art

In multi-scanning, video signals of low resolution (low video mode) can be enlarged in a vertical direction on an LCD panel of high resolution. Or, in the case of a LCD panel of low resolution, a video source may have its resolution reduced so that it may be displayed on the LCD panel. In the latter case, some of the video source data may be removed.

Enlargement of video signals in a horizontal direction can be easily achieved by increasing a sampling rate. In contrast, enlargement of video signals in the vertical direction, achieved in a method in which picture data are stored utilizing frame memories, isn't easily achieved.

In a conventional source driver of an LCD, image signals of resolution suitable for a corresponding LCD module are typically provided to a driving IC. Accordingly, the image signal resolution should be converted to that suitable for the LCD module. A conventional LCD source driver will be described with reference to FIGS. 1 and 2.

FIG. 1 is a block diagram of a 192-output, 6-bit gray-scale driving IC of a conventional LCD source driver. As shown, a conventional LCD source driver includes a 64 bit bidirectional shift register 1 for bidirectionally shifting a carry input/output (I/O) signal according to an external clock signal, a 192×6 bit latch 2 for successively storing external R, G, and B image signal data (6 bits each) according to the carry I/O signal and outputting stored data according to an external load signal, a 192×6 bit digital/analog (D/A) converter 3 for converting an image signal output by latch 2 to an analog signal based on an external POL signal, and data output circuit 4 that output the analog image signal from the D/A converter 3 to a TFT-LCD panel.

FIG. 2 shows in detail the structure of latch 2. As shown, latch 2 comprises two latch sections, a first latch section 2*a* and a second latch section 2*b*. Each latch section 2*a* and 2*b* is made up of three 192×6 bit latches for latching R, G, and B image signals respectively. When first latch section 2*a* stores image data in response to the external load signal, second latch section 2*b* outputs its image data into D/A converter 3. Conversely, when second latch section 2*b* stores image data, first latch section 2*a* outputs its image data. In this manner, latches 2*a* and 2*b* alternately store and output the image data.

In the operation of the conventional LCD source driver, if a VGA LCD module(640×480 image) is to be driven, at least 10 driving ICs are needed. This is because a VGA module has 1920 (640×3) dots per row (three dots—R (red), G (green), and B (blue), per pixel), but the illustrated driving IC has only 192 data outputs. Similarly, in an LCD module for a XGA (1024×768) image, which has 3072 (1024*3) dots per row is to be driven, at least 16 driving ICs are needed (192*16=3072). In summary, the number of needed driving ICs attached to an LCD panel depends on what kind of LCD module is used, and an image signal suitable for the module should be applied to the source driving IC.

If an image signal suitable for the module is applied, latches 2*a* and 2*b* store and output data alternately, controlled by the load signal. The data output from latch 2*a* and 2*b* is then converted by D/A converter 3 and transferred to the LCD panel by output circuit 4.

The conventional LCD source driver has the following problems. First, since the LCD source driver should be incorporated into a driving IC suitable for the corresponding LCD panel, and image signals suitable for the LCD panel should be used, the multi-scan function cannot be used. Second, when an image signal unsuitable for the module is intended to be displayed without changing or adding driving ICs, an extra converting section is required.

SUMMARY OF THE INVENTION

The present invention is directed to an LCD source driver and a method for driving the same that substantially obviates one or more of problems due to limitations and disadvantages of the related art.

An object of the invention is to provide an LCD source driver having a multi-scan function in which a panel and other video sources can be enlarged and reduced to be displayed in a suitable size for a screen.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the LCD source driver includes first, second, and third memory sections for storing in a corresponding address a line signal of image data, an output selecting part for selecting image data output by one of the first, second, and third memory sections, and a controller for controlling the reading and writing of the first, second, and third memory sections so as to operate one of the three memory sections in input mode, another section in hold mode, and the final memory section in output mode.

In another aspect of the invention, there is provided a method for driving and displaying image signals of difference resolutions on an LCD source driver having first, second, and third memory sections, including a first step of repeatedly selecting first, second, and third memory sections in an input mode, while simultaneously, repeatedly selecting the third, the first, and the second memory sections in output mode; and a second step of selecting a memory previously selected in output mode when the memory being operated in input mode is to be selected in output mode due to a difference between input and output rates.

It is to be understood that both the foregoing general description and the following detailed description are exemplary and explanatory and are intended to provide further explanation of the invention as claimed.

BRIEF DESCRIPTION OF THE DRAWINGS

The above and various other objects, features, and advantages of the present invention will be readily understood with reference to the following detailed description read in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
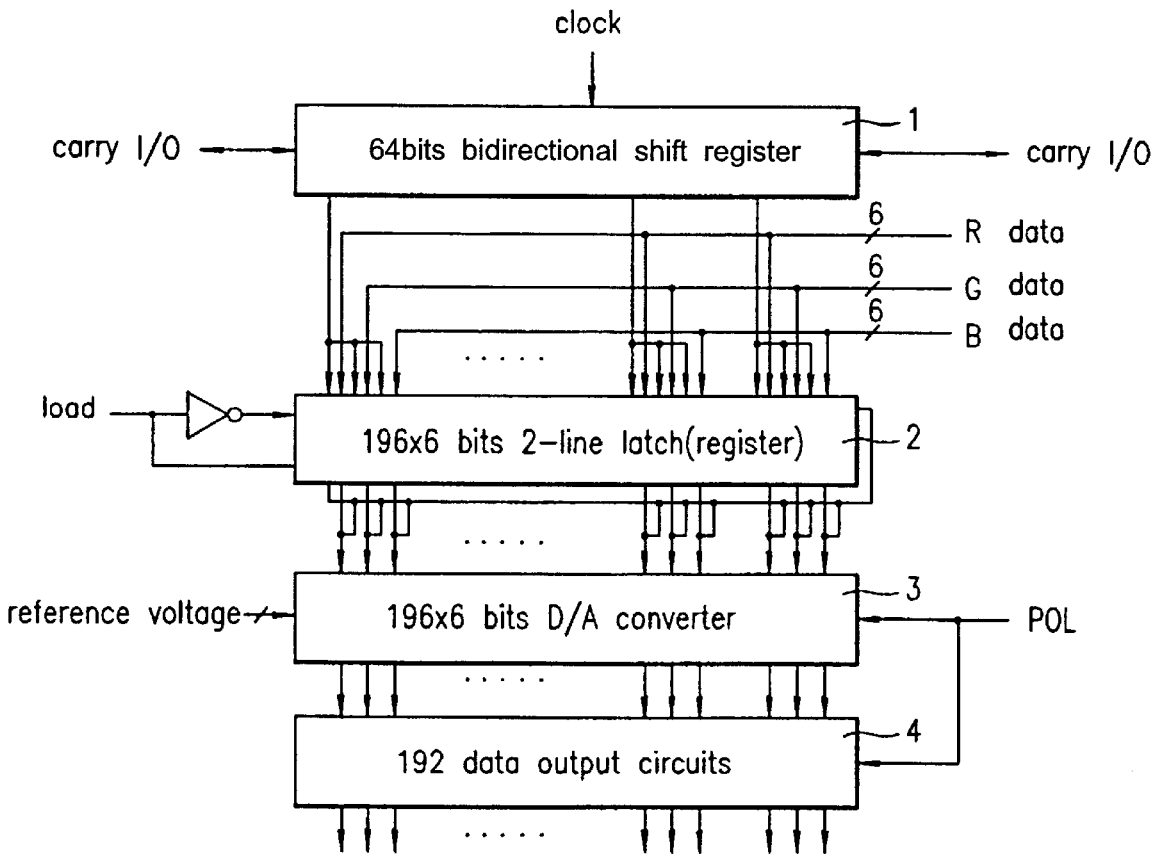
FIG. 1 PRIOR ART
FIG. 1 is a block diagram showing a structure of a conventional LCD source driver.
Figure 2:
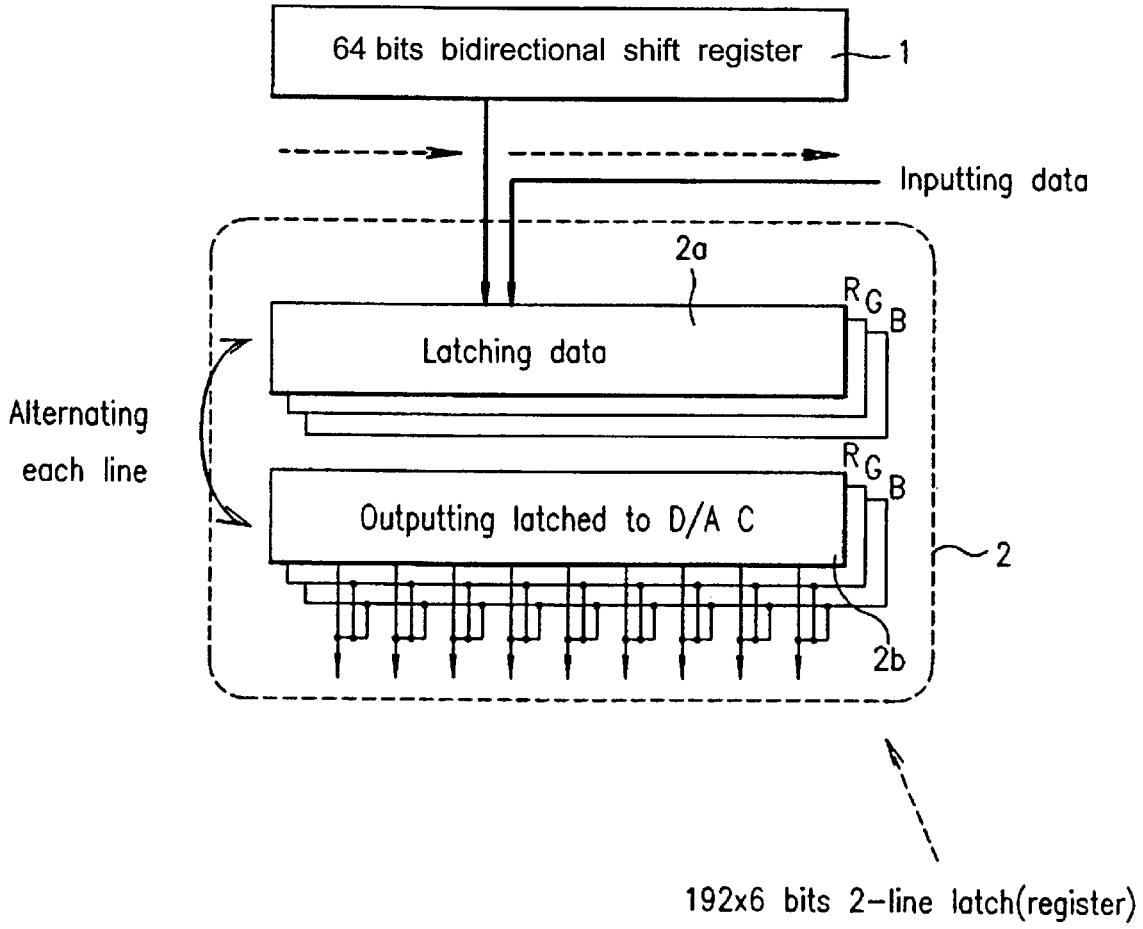
FIG. 2 PRIOR ART
FIG. 2 is a view showing the detailed structure of the 2-line latch shown in FIG. 1.
Figure 3:
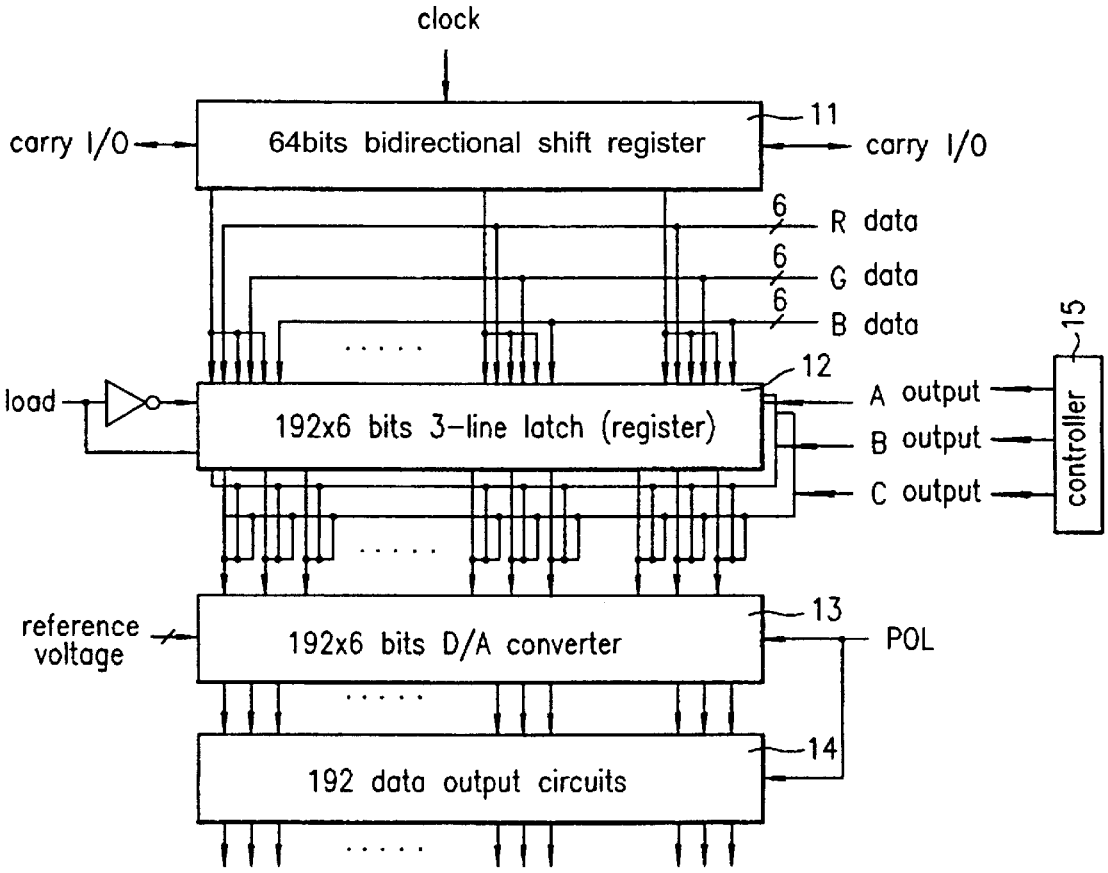
FIG. 3 is a block diagram showing a structure of an LCD source driver according to a first embodiment of the invention.
Figure 4:
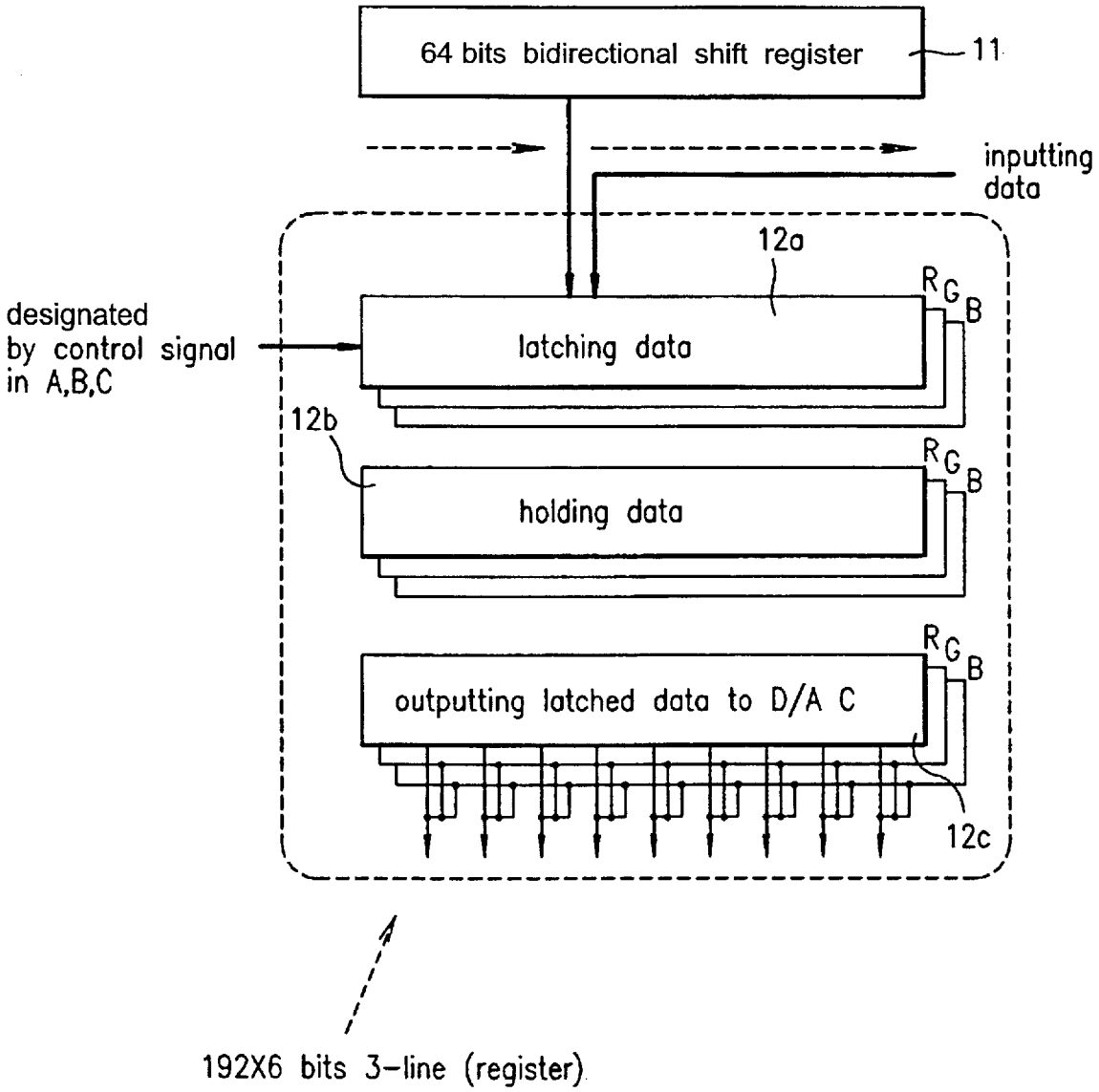
FIG. 4 is a detail view showing the structure of the latch in FIG. 3.

FIG. 3 is a block diagram showing an LCD source driver according to the first embodiment of the present invention—a 192-output 6-bit (gray-scale) source driver. As shown, the LCD source driver includes a 64 bit bidirectional shift register 11 for bidirectionally shifting a carry input/output signal according to an external clock signal. A latch section 12 comprising three latches (first, second, and third latches) that sequentially store, when in "data latch mode," R, G, and B image signal data (6 bits each) input in synchronization with the carry I/O signals from the 64 bit bidirectional shift resister 11. Latch section 12 also holds stored image data when in data hold mode and outputs image data when in data output mode. D/A converter 13 converts image data output by latch section 12 into an analog signal according to an external POL signal and data output circuit 14 transfers the analog image signal to a TFT-LCD according to the external POL signal. A controller 15 controls the inputting, outputting, and holding modes of the latch part 12.

The three latches comprising the latch section 12 each use, for example, a 192×6 bit memory. That is to say, the latch section 12 consists of three latches, called the first, second, and third latches 12*a,* 12*b,* and 12*c,* respectively, constructed to latch R, G, and B image data, and to repeatedly enter a data latch mode, a data hold mode, and a data output mode according to control signals from the controller 15.

Figure 5:
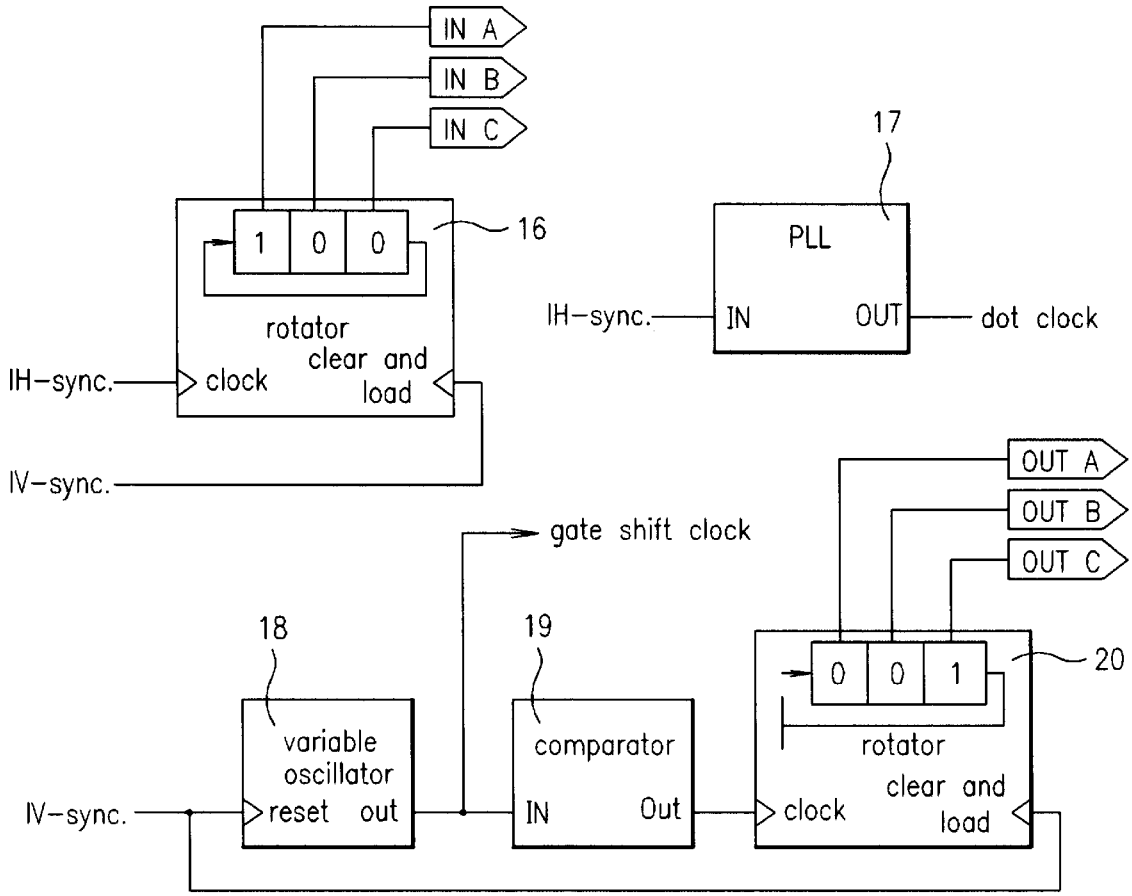
FIG. 5 is a detail view showing the structure of the controller in FIG. 3.

FIG. 5 shows controller 15 in more detail. Controller 15 includes a first selecting section 16 for outputting a selecting signal (labeled IN A, IN B, and IN C) to select among latches 12*a,* 12*b,* and 12*c* and uses the horizontal synchronizing signal of the image signal as a clock signal and the vertical synchronizing signal of the image signal as a clear & load signal. A PLL section 17 outputs a dot clock or a master clock signal by dividing the horizontal synchronizing signal into the number of corresponding LCD module lines (1024 in case of 1024×768). Variable oscillating section 18 outputs gate start pulses of the number of scan lines of the LCD module during a vertical synchronizing period (768 in case of 1024×768), allowing reduction or enlargement in a vertical direction by varying the frequency of the gate start pulses. Comparator 19 ensures the data output mode and data latch mode do not happen simultaneously and second selecting section 20 selects one of latches 12*a,* 12*b,* and 12*c* to operate using the signal output from comparator 19 as a clock signal and the vertical synchronizing signal of the image signal as a clear & load signal.

Figure 6:
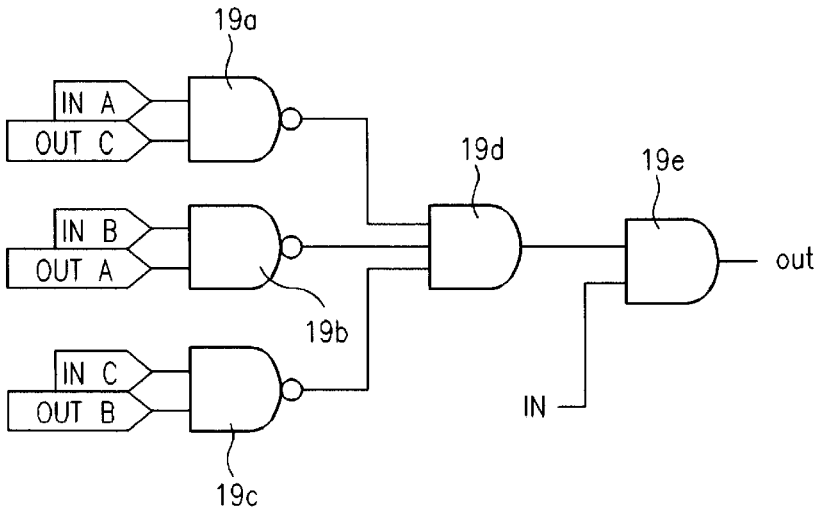
FIG. 6 is a circuit diagram of the comparator of FIG. 5.

FIG. 6 is a block diagram illustrating comparator 19 in detail. This comparator includes three NAND gates 19*a,* 19*b,* and 19*c,* and two AND gates 19*d* and 19*e,* connected as shown. NAND gate 19*a* operates on signal IN A output from the first selecting section 16 and the OUT C signal output from the second selecting section 20. Similarly, NAND gate 19*b* operates on IN B and OUT C, and NAND gate 19*c* operates on IN C and OUT B. AND gate 19*e* operates on the output of the first AND gate 19*d* and an output signal of the variable oscillating part 18.

Figure 7:
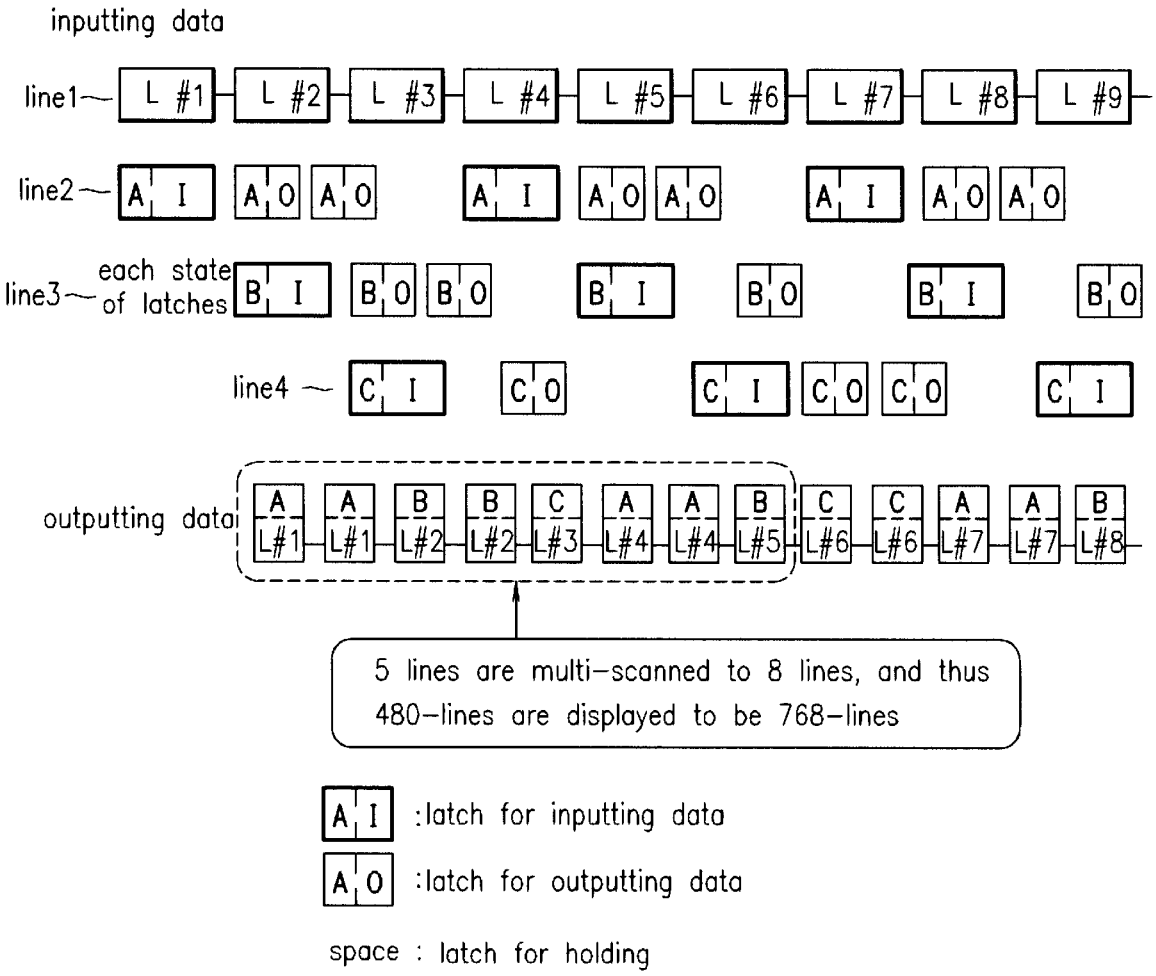
FIG. 7 is an illustration of the operation of multi-scan in the LCD source driver according to the first embodiment of the invention.

FIG. 7 illustrates the operation of a multi-scan function of the LCD source driver according to the first embodiment of the invention. In this illustration, VGA image data is to be displayed on an LCD panel capable of XGA resolution.

Whenever there is a horizontal synchronizing signal H-sync, the first selecting section 16, sequentially controls latches 12*a,* 12*b,* and 12*c* so that they alternately enter data latch mode. This selection process is performed repeatedly. If a horizontal synchronizing signal H-sync is received while repeating the selection of the latches, the first latch 12*a* is operated. PLL 17 divides a horizontal synchronizing signals H-sync of a VGA image signal into 1024. One of the three latches is selected to be operated in latch mode by the first selecting section 16, and simultaneously one of the three latches is selected to be operated in output mode by the second selecting section 20. The operation of the second selecting section 20 is initialized again so that the third latch 12*c* first operates in output mode and then the first and second latches 12*a* and 12*b* are operated in turn under the control of the variable oscillating part 18 and the comparator 19.

That is, once the first selecting section 16 is initialized, it selects latch 12*a* to be in data latch mode, and second selecting section 20 controls latch 12*c* to be in data output mode. The variable oscillating part 18 outputs 768 gate start pulses so as to display the XGA resolution during a vertical synchronizing period.

Also, comparator 19 performs a logical product of the signals from section sections 16 and 20 such that a clock signal is output by the variable oscillating part 18. That is, the first selecting part 16 outputs a selecting signal IN A so that the first latch 12*a* is operated in data latch mode in the beginning, while the second selecting part 20 outputs a selecting signal OUT C so that the third latch is operated in data output mode. Accordingly, because NAND gate 19*a* of the comparator 19 outputs a signal of low, the first and second AND gates 19*d* and 19*e* output low signals regardless of the output of NAND gates 19*b* and 19*c,* and thus a clock signal is not applied to the second selecting section 20. Accordingly, the second selecting section 20 operates the third latch 12*c* in data output mode. However, since no data is stored in the third latch 12*c,* there is no output data.

In this manner, the first selecting section 16 selects latch 12*a* in data latch mode so that an input image signal of a first line is stored in the first latch 12*a*. Then, the signal is synchronized with a next horizontal synchronizing signal so as to select the second latch 12*b* in data latch mode. Accordingly an input image signal of a second line is stored in the second latch 12*b*.

At this time, the first selecting section 16 selects the second latch 12*b* in data latch mode IN B and the second selecting section 20 selects the third latch 12*c* in data output mode OUT C so that the first, second, and third NAND gates 19*a,* 19*b,* and 19*c* output signals of high, the first AND gate 19*d* outputs a signal of high, and the second AND gate 19*e* outputs a pulse of the variable oscillating part 18 to the second selecting section 20. Triggered by the pulse output from comparator 19, the second selecting section 20 outputs a selecting signal OUT A driving the first latch 12*a* to data output mode. Accordingly, the first and second latches 12*a* and 12*b* are operated in data output mode and in data latch mode, respectively.

While the second latch 12*b* latches data in at the VGA resolution rate, the first latch 12*a* outputs data at the XGA resolution rate. Thus, before a second line of input image data is latched into the second latch 12*b,* the image data of the first line, which is latched in latch 12*c,* is output to D/A converter 13. Although all data latched in the first latch 12*a* are output, the second selecting section 20 continues to output selecting signals OUT A so as to operate the first latch 12*a* in data output mode, because the second selecting section 20 doesn't output clock signals. Accordingly, while the second latch 12*b* is latching data as shown in FIG. 7, the first latch 12*a* outputs data latched in the first latch 12*a* twice.

After the image signal of the second line is completely latched in the second latch 12*b* and a following horizontal synchronizing signal is input, the first selecting section 16 outputs selecting signals IN C so that the third latch 12*c* is operated in data latch mode. Simultaneously, the comparator 19 outputs a clock signal to the second selecting section 20 since selecting signals IN C and OUT A are high and the rest of the selecting signals are low.

Therefore, in the foregoing manner, the second selecting section 20 outputs a selecting signal OUT B so that the second latch 12*b* is operated in data output mode. At this time, NAND gate 19*c* outputs a low signal so that a clock signal is not applied to the second selecting section 20.

If all data latched in the second latch are output before the third latch 12*c* doesn't finish latching data, the data latched by the second latch are output again. If the first selecting selection 16 selects the first latch 12*a* in data latch mode, the second selecting section 20 makes the third latch 12*c* operate in data output mode. At this time, while data latched in the third latch 12*c* is output, data in a next line is latched into the second latch 12*b* after all input image signal data in a line have been latched in the first latch 12*a,* so that data latched in the third latch 12*c* are outputted only once and data latched in the first latch 12*a* is output. As a result, five lines of image signals of VGA resolution are multi-scanned into eight lines and thus 480-lines are displayed as 768-lines.

The operation of an LCD source driver according to the second embodiment of the invention is similar to the first embodiment, however, in the second embodiment, the LCD source driver is different from the first embodiment.

Figure 8:
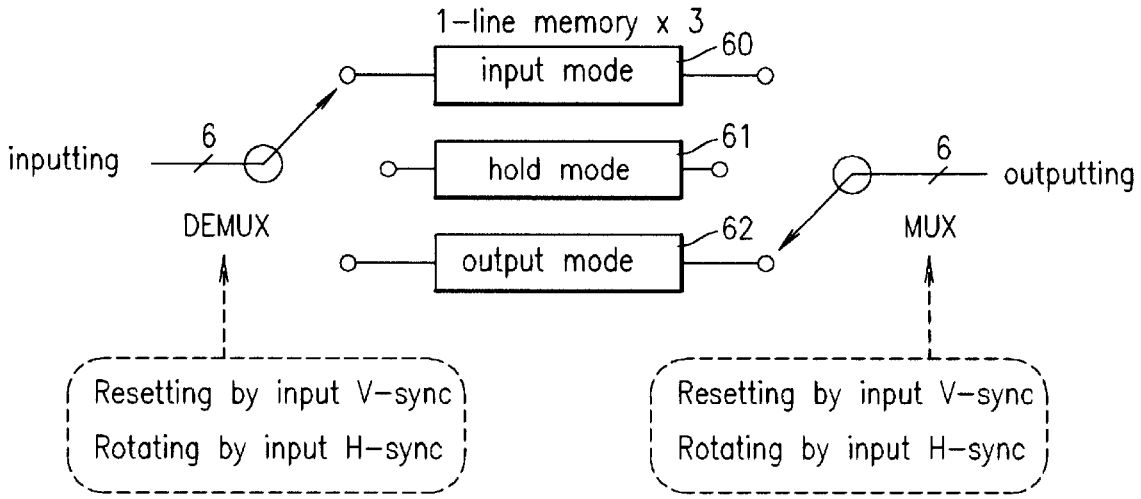
FIG. 8 is an illustration of an LCD source driver according to a second embodiment of the invention.

The LCD source driver includes three line memories 60, 61, and 62, as shown in FIG. 8, and is switched so that it operates either in input mode, hold mode, or in output mode, as controlled by a multiplexer and a demultiplexer. Through this structure, in a manner similar to the first embodiment, multi-scanning can be achieved. SRAMs or DRAMs can be used in place of the line memories.

It is assumed that image signals of VGA resolution are displayed on a panel of XGA resolution in the same manner as the first embodiment. A source driver of an identical structure is needed for each of R, G, and B image signals, but only one color signal will be described.

Figure 9:
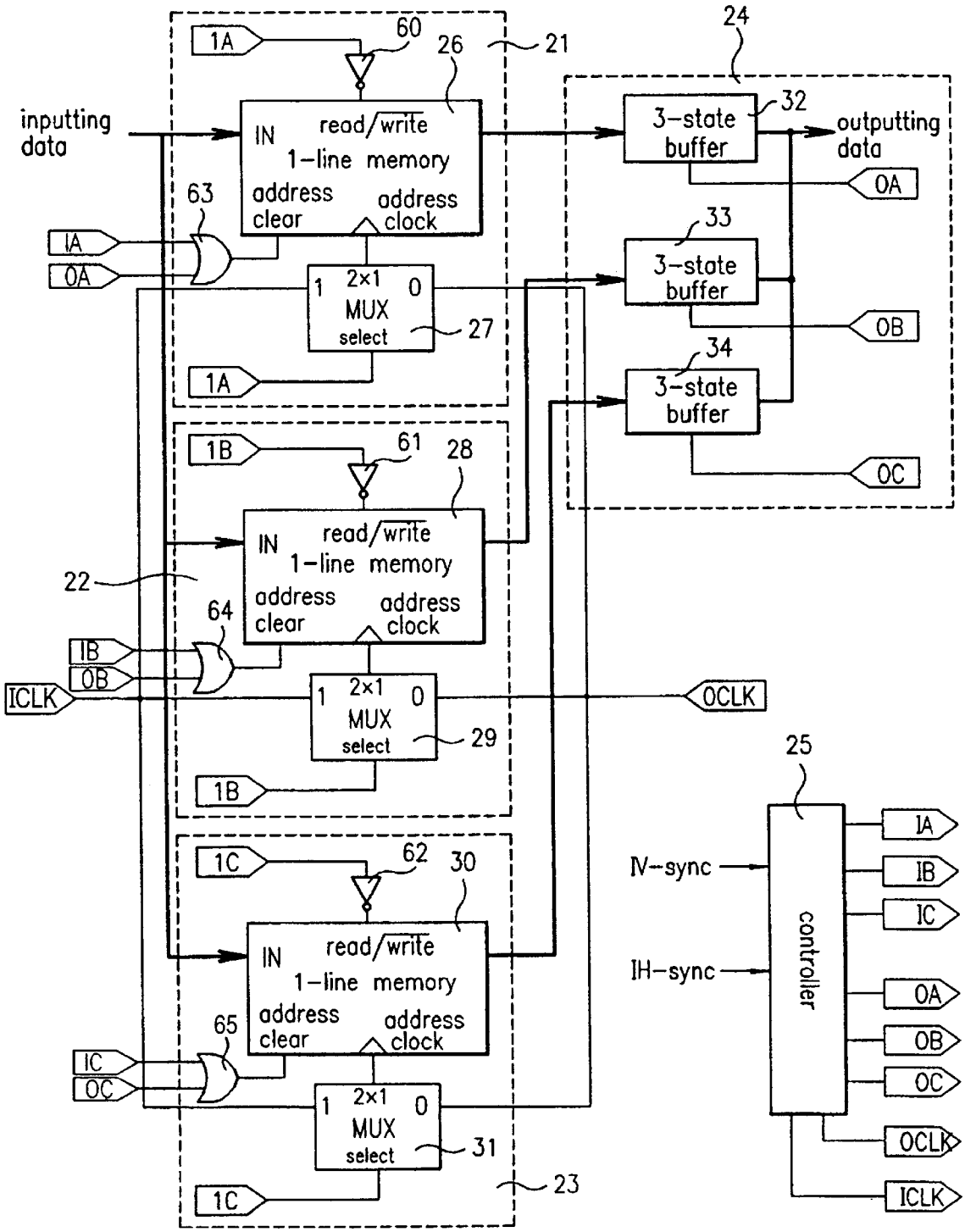
FIG. 9 is a block diagram showing a structure of the LCD source driver according to the second embodiment of the invention.

The LCD source driver according to the second embodiment of the invention, as shown in FIG. 9, includes a first memory section 21 consisting of a first memory 26 and a first multiplexer 27 for writing, in an appropriate address, a line signal of image data input based on an external control signal. Second and third memory sections 22 and 23, and second and third multiplexers 29 and 31, are constructed similarly. Output selecting section 24 includes three tri-state buffers 32, 33, and 34 for selecting an output signal from first, second, and third memory sections 21, 22, and 23. Controlling section 25 controls memory operations (reading or writing) of each of the memory sections 21, 22, and 23, multiplexers 27, 29, and 31, and output of the output selecting section so as to operate one of the first, second, and third memory sections 21, 22, and 23 in input mode, another memory section in hold mode, and the other memory section in output mode by receiving vertical and horizontal synchronizing signals IV-sync and IH-sync of a VGA resolution image signal.

VGA image signals are input to input terminals of memories 26, 28, and 30. Selecting signals of the controlling section 25 are applied to a read/write terminal through inverters 60, 61, and 62. Output signals of multiplexers 27, 29, and 31 are input to the address clock terminals; and output terminals are connected to the output selecting section 24. OR gates 63, 64, and 65 perform a logical OR operation on the input and output selecting signals.

Input clock signals ICLK and output clock signals OCLK are input to input terminals of the multiplexers 27, 29, and 31 and selecting signals of the controller 25 are input to the selecting terminals. Horizontal synchronizing signals of VGA image signals are divided as sampling clocks which are the input clock signals ICLK which are made to sample 1024 lines for one horizontal period. The output clock signals OCLK read data in the memories for driving the LCD panel and are input to driving ICs.

Figure 10:
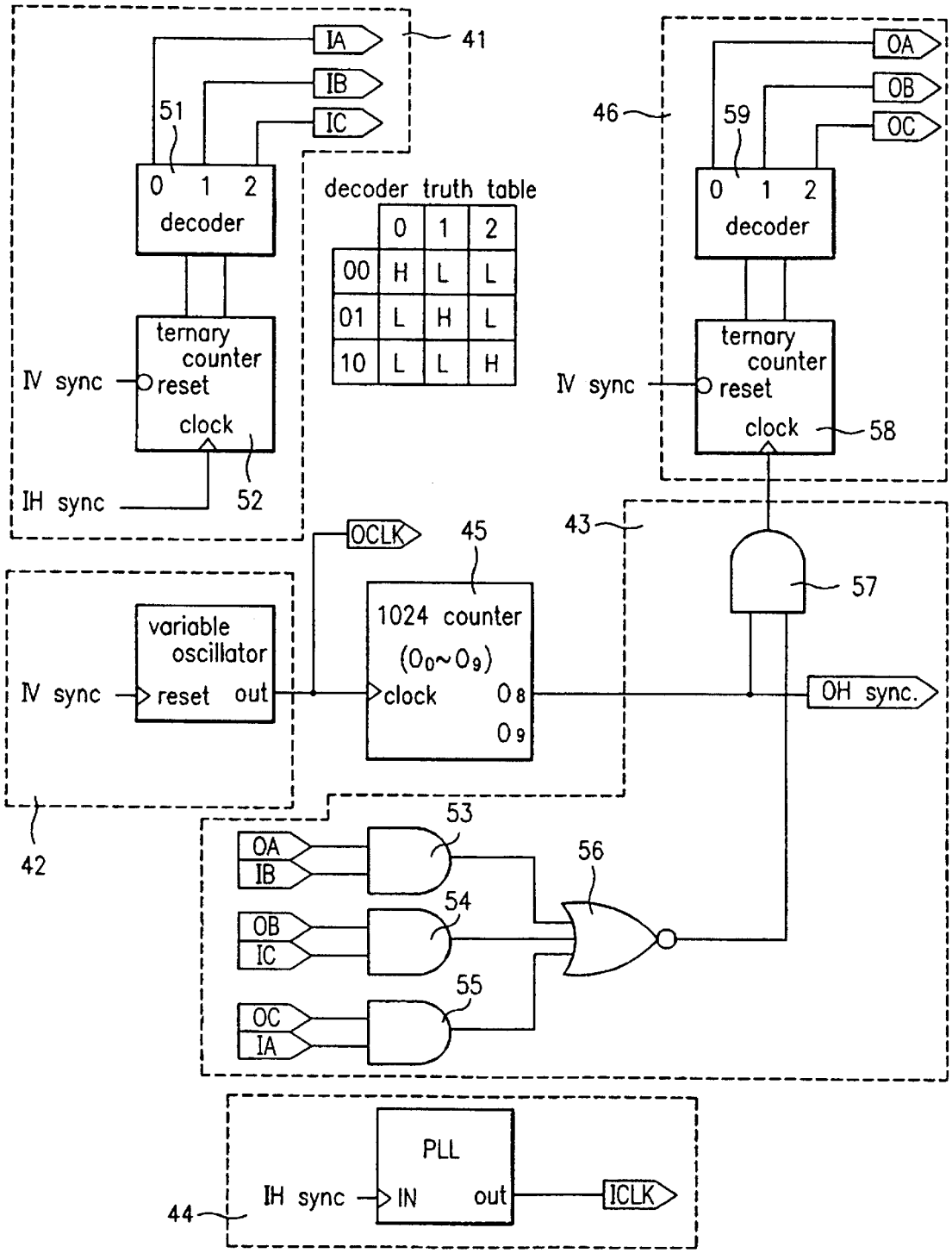
FIG. 10 is a detailed circuit diagram of a controller of FIG. 9.

FIG. 10 illustrates the structure of the controller 25 in more detail. Controller 25 includes a first selecting section 41 including a first ternary counter 52 and a first decoder 51 for outputting selecting signals IA, IB, and IC that cause memory sections 21, 22, and 23, respectively, to operate in input mode based on a horizontal synchronizing signal IH-sync of VGA image signal as a clock signal and a vertical synchronizing signal IV-sync as a reset signal. PLL 44 outputs a clock signal ICLK used to sample 1024 lines in one horizontal period by dividing the horizontal synchronizing signal IH-sync of input VGA image signal into 1024. A variable oscillating part 42 transmits 768 gate start pulse signals OCLK for a vertical period by using the vertical synchronizing signal IV-sync of input VGA image signal as a reset signal. Counter 45 is a ten bit counter for outputting a vertical synchronizing signal OH-sync of the LCD panel by counting 1024 clock signal outputs by the variable oscillating part 42. Comparator 43 includes 4 AND gates 53, 54, 55, and 57, and a NOR gate 56 for making one of the memory sections simultaneously operate in an input mode and an output mode. Comparator 43 performs a first logical product of the selecting signals of the first selecting part IA, IB, and IC and selecting signals of the second selecting part OA, OB, and OC, and operating a second logical product of output pulse signals from the ten-bit counter. A second selecting section 46 includes a second ternary counter 58 and a second decoder 59 for outputting selecting signals OA, OB, and OC so as to operate one of the memory parts 21, 22, and 23 in output mode by using the vertical synchronizing signal IV-sync of inputted VGA image signal as a reset signal and the output signal of the comparator 43 as a clock signal.

The operation of the LCD source driver according to the second embodiment is similar to that of the first embodiment. The LCD source driver is composed of three memory sections, and each of the memory sections is designed to be operated by sequentially rotating its input mode, hold mode, and output mode. In this LCD source driver, there is a difference between a time for writing an image line in VGA and a time for reading an image line in XGA; reading and writing are made to be simultaneously not performed in one memory; and if a memory intended to be read is in writing mode (inputting mode), a image signal data written in advance is read once more to perform multi-scanning.

In the operation of the controlling section 25, in the first selecting section 41, the first ternary counter 52 counts a horizontal synchronizing signal of an input VGA (640×480) image signal, and the first decoder 51 decodes it so as to output selecting signals IA, IB, and IC so that the VGA image signals are repeatedly input one line by one line to the first, second, and third memory parts 21, 22, and 23. This process is performed for one vertical period. Whenever a vertical synchronizing signal is input, this process is initialized.

The PLL section 44 divides a horizontal synchronizing signal of an input VGA image signal into 1024 clock signals (data driving clock of XGA) for outputting a dot clock ICLK because VGA and XGA image signals sample 640 clock signals and 1024 clock signals, respectively, for a horizontal synchronization period.

The variable oscillating part 42, using a vertical synchronizing signal IV-sync as an input transmits 768 pulse signals for each vertical synchronizing period and outputs them to the gate pulse. That is to say, 480 pulses and 768 pulses should be transmitted to display VGA and XGA image signals, respectively, for a vertical synchronization period. At this time, these pulses mean a rate of reading data in a memory selected in output mode. The ten-bit counter 45, counts signals OCLK output by the variable oscillating part 42 and outputs horizontal synchronizing signals OH-sync required to display a panel of XGA module.

In case signal OA and signal IB are selected simultaneously, or in case signal OB and signal IC are selected simultaneously, or in case signal OC and signal IA are selected simultaneously, the comparator 43 does not output the signal OH-sync output by the ten-bit counter 45. But in other cases, the signals OH-sync output by the ten-bit counter 45 is output to the second selecting part 46. That is, if the signals OA and IB are selected simultaneously, the first AND gate 53 outputs a signal of high. If signals OB and IC are selected simultaneously, the second AND gate 54 outputs a signal of high. If signal OC and IA are selected simultaneously, the third AND gate 55 outputs a signal of high. If a signal of high is output by any of the first, second, and third AND gates, NOR gate 56 outputs a signal of low, and therefore no clock signal is applied to the second selecting section 46.

The second selecting section 46 outputs a selecting signal so that the third, first, and second memory parts 23, 21, and 22 are operated in output mode by turns.

As described above, the controlling section 25 at first selects the first memory section in input mode and the third memory section in output mode, thus writing one line of VGA image signal in the first memory section. After the input mode of the first memory section, the controlling section 26 selects the second memory section in input mode and simultaneously selects the first memory section in output mode. At this time, since image signal data written in a line are written at VGA resolution rate, and data from a line is read at a XGA resolution rate, the output mode is faster than the input mode. Thus, the output mode and input mode can not be selected simultaneously in one memory section. Accordingly, if the second memory section is in input mode and the first memory section is in output mode, the first memory section may be again selected in output mode. Thereafter, if the input mode of the second memory section is finished, the third memory section is set to input mode and the second memory section is set to output mode. In the same manner, if the output mode of the second memory section is finished earlier than the input mode of the third memory section, the second memory section is selected in output mode again. Likewise, five lines of VGA image signals are multi-scanned in eight XGA image signal modules.

An LCD source driver and a method for driving the same according to the present invention have the following advantages.

First, circuit construction required for multi-scanning becomes simpler.

Second, if the LCD source driver of the invention is attached to an LCD panel, image signals of various resolutions can be multi-scanned without extra circuits.

It will be apparent to those skilled in the art that various modification and variations can be made in the LCD source driver and the method for driving the same of the present invention without departing from the spirit or scope of the inventions. Thus, it is intended that the present invention cover the modifications and variations of this invention provided they come within the scope of the appended claims and their equivalents.

What is claimed is:

1. A liquid crystal device (LCD) source driver comprising:

a shift register for shifting and outputting a carry input/output (I/O) signal, a latch section including first, second and third latches, each for inputting, R, G and B external image data, holding the input date, or and outputting the held data synchronously with the carry I/O signal;

a digital/analog (D/A) converter for converting the image data output by the latch section into an analog image signal synchronously with an external polarity control signal;

a data output section for outputting the analog signal to an LCD panel; and a controlling section for controlling operation of the first, second and third latches so as to operate one of the first, second and third latches in input mode, another of the latches in hold mode and the other of the latches in output mode.

2. The LCD source driver as claimed in claim 1, wherein said controling section comprises:

a first selecting section for outputting a signal to select one of the first, second, and third latches to be operated in a data latch mode;

a phase lock loop (PLL) section for outputting a dot clock by dividing a horizontal synchronizing signal of an input image signal into a number of lines of a corresponding LCD module;

a variable oscillating section for outputting gate start pulses of the number of scan lines of the LCD module for a vertical synchronizing period;

a comparing section for ensuring operating in a data output mode and data latch mode occur in separate latches of the latch section; and a second selecting section for selecting one of the latches to be operated in data output mode according to a signal output by the comparing section.

3. The LCD source driver as claimed in claim 2, wherein said first selecting section further comprises a rotator for repeatedly outputting a selecting signal by using a horizontal synchronizing signal of input image signal as a clock signal and a vertical synchronizing signal as a clear and load signal, so that the first, second, and then third latches are sequentially selected in latch mode.

4. The LCD source driver as claimed in claim 2, wherein said second selecting section further comprises a rotator for repeatedly selecting a selecting signal by using an output signal of the comparing section as a clock signal and a vertical synchronizing signal of input image data as a clear and load signal, so that the third, first, and then second latches are selected sequentially in data output mode.

5. The LCD source driver as claimed in claim 2, wherein the comparing section further comprises:

a first NAND gate for performing an inverted logical product of a first latch mode selecting signal output by the first selecting section and a third output mode selecting signal output by the second selecting section;

a second NAND gate for performing an inverted logical product of a second latch mode selecting signal output by the first selecting section and a first output mode selecting signal output by the second selecting section;

a third NAND gate for performing an inverted logical product of a third latch mode selecting signal output by the first selecting section and a second output mode selecting signal output by the second selecting section;

a first AND gate for performing a logical product of the signals output by the first, second, and third NAND gates; and a second AND gate for operating a logical product of an output signal of the first AND gate and an output signal of the variable oscillating section and outputting the logical result to the second selecting section.

6. An liquid crystal device (LCD) source driver comprising:

first, second, and third memory sections for storing a line signal of image data by an external control;

an output selecting section for selecting an output signal of one of the first, second, and third memory sections; and a controlling section for controlling the writing and reading of each of the first, second, and third memory sections and the output signal of the output selecting section so as to operate one of the first, second, and third memory sections in input mode, another of the memory sections in hold mode, and the other of the memory sections in output mode.

7. The LCD source driver as claimed in claim 6, wherein the output selecting section comprises tri-state buffers for buffering data output by each of the first, second, and third memory sections.

8. The LCD source driver as claimed in claim 6, wherein the first, second, and third memory sections comprise:

a multiplexer for outputting either a reading clock or a writing clock according to a control signal for the controlling section;

an OR gate for performing a logical product of input/output selecting signals of a corresponding memory and an inverter for inverting an input selecting signal of the controlling section; and a memory for reading or writing according to the controlling section by inputting a selecting signal of the controlling section through the inverter, by using an output of the multiplexer as an address clock and an output of the OR gate as an address clear signal.

9. The LCD source driver as claimed in claim 6, wherein the controlling section comprises:

a first selecting section for outputting a first set of selecting signals so as to operating one for the first, second and third memory sections in an input mode;

a phase lock loop section for outputting a dot clock by dividing a horizontal signal of an input image signal into the number of lines of a corresponding LCD module;

a variable oscillating section for outputting gate start pulses of the number of scan lines of the LCD module for a vertical synchronizing period;

a vertical synchronizing signal counter for outputting vertical synchronizing signals of the LCD panel by counting clock signals output by the variable oscillating part, of as many as the number of the lines of the corresponding LCD module;

a comparing section for performing a comparison operation so that one of the memory sections does not operate simultaneously in input mode and output mode; and a second selecting section for outputting a second set of selecting signals so as to operate one of the first, second and third memory sections in output mode.

10. The LCD source driver as claimed in claim 9, wherein the first selecting section comprises:

a ternary counter for counting in ternary by using a vertical synchronizing signal of an input image signal as a reset signal and a horizontal synchronizing signal as a clock signal; and a decoder for outputting first, second and third selecting input signals so as to operate one of the three memory sections in input mode by decoding a signal output by the ternary counter.

11. The LCD source driver as claimed in claim 9, wherein the first selecting section outputs a selecting signal so as to sequentially operate the first, second, and third memory sections in an input mode.

12. The LCD source driver as claimed in claim 9, wherein the second selecting section comprises:

a ternary counter for counting in ternary by using a vertical synchronizing signal of input image data as a reset signal and in output signal of the comparing part as a clock signal; and a decoder for outputting first, second and third selecting output signals so as to operate one of the three memory sections in output mode by decoding a signal output by the ternary counter.

13. The LCD source driver as claimed in claim 9, wherein the second selecting section outputs a selecting signal so as to sequentially operate the third, first, and then second memory sections in output mode.

14. The LCD source driver as claimed in claim 9, wherein the comparing section comprises:

a first AND gate for performing a logical product of a first memory section first selecting output signal of the second selecting section and a second memory section second selecting input signal of the first selecting section;

a second AND gate for performing a logical product of a second memory section second selecting output signal of the second selecting section and a third memory third selecting input signal of the first selecting section;

a third AND gate for performing a logical product of a third memory section third selecting output signal of the second selecting section and a first memory first selecting input signal of the first selecting section;

a NOR gate for performing a logical product of output signals of the first, second, and third AND gates for inversion; and a fourth AND gate for performing a logical product of an output of the NOR gate and an output of the vertical synchronizing signal counter and outputting the logical product.

15. A method for driving an LCD source driver including first, second, and third memories for displaying image signals of different resolutions, comprising the steps of:

repeatedly and sequentially selecting the first, second, and third memories in an input mode, and then simultaneously and repeatedly selecting the third, first, and second memories in output mode;

selecting a memory previously selected in output mode when a memory which is being operated in input mode is selected in output mode due to differences between input and output rates corresponding to image signals of different resolutions; and repeating the first and second steps for a vertical synchronizing period of an input image signal.

16. A liquid crystal device (LCD) source driver comprising:

a shift register for shifting and outputting a carry input/output (I/O) signal;

a latch section including first, second and third latches for sequentially storing external image data (R, G and B), holding the stored data, and outputting the stored data synchronously with the carry I/O signal;

a digital/analog (D/A) converter for converting the image data output by the latch section into an analog image signal synchronously with an external polarity control (POL) signal;

a data output section for outputting the analog image signal to an LCD panel;

a controlling section for controlling operation of the first, second, and third latches so as to operate one of the first, second and third latches in data input mode, another of the latches in data hold mode and the other of the latches in data output mode wherein the controlling section comprises:

a first selecting section for outputting a signal to select one of the first, second, and third latches to be operated in a data latch mode;

a phase lock loop (PLL) section for outputting a dot clock by dividing a horizontal synchronizing signal of an input image signal into a number of lines of a corresponding LCD module;

a variable oscillating section for outputting gate start pulses of the number of scan lines of the LCD module for a vertical synchronizing period;

a comparing section so as to operate one of the first, second and third latches in data output mode, and another of the latches in data latch mode; and a second selecting section for selecting one of the latches to be operated in data output mode according to a signal output by the comparing section.

17. The LCD source driver as claimed in claim 16, wherein said first selecting section further comprises a rotator for repeatedly outputting a selecting signal by using a horizontal synchronizing signal of input image signal as a clock signal and a vertical synchronizing signal as a clear and load signal, so that the first, second, and then third latches are sequentially selected in latch mode.

18. The LCD source driver as claimed in claim 16, wherein said second selecting section further comprises a rotator for repeatedly selecting a selecting signal by using an output signal of the comparing section as a clock signal and a vertical synchronizing signal of input image data as a clear and load signal, so that the third, first, and then second latches are selected sequentially in data output mode.

19. The LCD source driver as claimed in claim 18, wherein the comparing section further comprises:

a first NAND gate for performing an inverted logical product of a first latch mode selecting signal output by the first selecting section and a third output mode selecting signal output by the second selecting section;

a second NAND gate for performing an inverted logical product of a second latch mode selecting signal output by the first selecting section and a first output mode selecting signal output by the second selecting section;

a third NAND gate for performing an inverted logical product of a third latch mode selecting signal output by the first selecting section and a second output mode selecting signal output by the second selecting section;

a first AND gate for performing a logical product of the signals output by the first, second, and third NAND gates; and a second AND gate for operating a logical product of an output signal of the first AND gate and an output signal of the variable oscillating section and outputting the logical result to the second selecting section.

* * * * *

UNITED STATES PATENT AND TRADEMARK OFFICE

CERTIFICATE OF CORRECTION

PATENT NO. : 6,333,730 B1
DATED : December 25, 2001
INVENTOR(S) : Seung-Jong Lee It is certified that error appears in the above-identified patent and that said Letters Patent is hereby corrected as shown below:

Title page,
Item [57], ABSTRACT,
Line 9, after "converter", delete "for".
Line 11, after "output part", delete "for".

Column 8,
Line 39, before "outputting", delete "and".
Line 53, "controling" should read -- controlling --.

Column 9,
Line 40, "An liquid" should read -- A liquid --.

Signed and Sealed this

Fifth Day of November, 2002

*Attest:*

*Attesting Officer*

JAMES E. ROGAN
*Director of the United States Patent and Trademark Office*